US006346869B1

(12) United States Patent
Marple et al.

(10) Patent No.: US 6,346,869 B1
(45) Date of Patent: Feb. 12, 2002

(54) RATING PLUG FOR CIRCUIT BREAKERS

(75) Inventors: James A. Marple, Newtown, CT (US); Aaron Soucy, Spring Valley, CA (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/473,180

(22) Filed: Dec. 28, 1999

(51) Int. Cl.[7] ..... H01H 9/02
(52) U.S. Cl. ..... 335/202; 335/176; 335/132
(58) Field of Search ..... 335/6, 17, 132, 335/202, 167–176

(56) References Cited

U.S. PATENT DOCUMENTS

| | | | |
|---|---|---|---|
| 2,340,682 | A | 2/1944 | Powell |
| 2,719,203 | A | 9/1955 | Gelzheiser et al. |
| 2,937,254 | A | 5/1960 | Ericson |
| 3,158,717 | A | 11/1964 | Jencks et al. |
| 3,162,739 | A | 12/1964 | Klein et al. |
| 3,197,582 | A | 7/1965 | Norden |
| 3,307,002 | A | 2/1967 | Cooper |
| 3,517,356 | A | 6/1970 | Hanafusa |
| 3,631,369 | A | 12/1971 | Menocal |
| 3,803,455 | A | 4/1974 | Willard |
| 3,883,781 | A | 5/1975 | Cotton |
| 4,129,762 | A | 12/1978 | Bruchet |
| 4,144,513 | A | 3/1979 | Shafer et al. |
| 4,158,119 | A | 6/1979 | Krakik |
| 4,165,453 | A | 8/1979 | Hennemann |
| 4,166,988 | A | 9/1979 | Ciarcia et al. |
| 4,220,934 | A | 9/1980 | Wafer et al. |
| 4,255,732 | A | 3/1981 | Wafer et al. |
| 4,259,651 | A | 3/1981 | Yamat |
| 4,263,492 | A | 4/1981 | Maier et al. |
| 4,276,527 | A | 6/1981 | Gerbert-Gaillard et al. |
| 4,297,663 | A | 10/1981 | Seymour et al. |

(List continued on next page.)

FOREIGN PATENT DOCUMENTS

| | | |
|---|---|---|
| BE | 819 008 A | 12/1974 |
| DE | 12 27 978 | 11/1966 |
| DE | 30 47 360 | 6/1982 |
| DE | 38 02 184 | 8/1989 |
| DE | 38 43 277 | 6/1990 |
| DE | 44 19 240 | 1/1995 |
| EP | 0 061 092 | 9/1982 |
| EP | 0 064 906 | 11/1982 |
| EP | 0 066 486 | 12/1982 |
| EP | 0 076 719 | 4/1983 |
| EP | 0 117 094 | 8/1984 |
| EP | 0 140 761 | 5/1985 |
| EP | 0 174 904 | 3/1986 |
| EP | 0 196 241 | 10/1986 |
| EP | 0 224 396 | 6/1987 |

(List continued on next page.)

*Primary Examiner*—Lincoln Donovan
(74) *Attorney, Agent, or Firm*—Cantor Colburn LLP; Carl B. Horton

(57) ABSTRACT

An improved rating plug housing is presented for use with circuit breakers having electronic trip units. The housing (10) for the rating plug has a series of protruding tabs (14) on the bottom of the housing (10). A trip unit housing (50) forms part of a circuit breaker housing. Trip unit housing (50) includes a recess (52) for receiving the trip unit housing (10). Recess (52) has a series of castellations (54) on the bottom of the recess (52). If a rating plug is appropriate for a given trip unit, the pattern of tabs (14) and castellations (54) will not interfere, and insertion will be permitted. If a rating plug is not appropriate for a given trip unit, the pattern of tabs (14) and castellations (54) will interfere, and insertion will not be permitted. Tabs (14) or projections (53) may be removed from housing (10) or recess (52) using a hand-held tool.

5 Claims, 1 Drawing Sheet

U.S. PATENT DOCUMENTS

| | | | | | |
|---|---|---|---|---|---|
| 4,301,342 | A | | 11/1981 | Castonguay et al. | |
| 4,360,852 | A | | 11/1982 | Gilmore | |
| 4,368,444 | A | | 1/1983 | Preuss et al. | |
| 4,375,021 | A | | 2/1983 | Pardini et al. | |
| 4,375,022 | A | | 2/1983 | Daussin et al. | |
| 4,376,270 | A | | 3/1983 | Staffen | |
| 4,383,146 | A | | 5/1983 | Bur | |
| 4,392,036 | A | | 7/1983 | Troebel et al. | |
| 4,393,283 | A | | 7/1983 | Masuda | |
| 4,401,872 | A | | 8/1983 | Boichot-Castagne et al. | |
| 4,409,573 | A | | 10/1983 | DiMarco et al. | |
| 4,435,690 | A | | 3/1984 | Link et al. | |
| 4,467,297 | A | | 8/1984 | Boichot-Castagne et al. | |
| 4,468,645 | A | | 8/1984 | Gerbert-Gaillard et al. | |
| 4,470,027 | A | | 9/1984 | Link et al. | |
| 4,479,143 | A | | 10/1984 | Watanabe et al. | |
| 4,488,133 | A | | 12/1984 | McClellan et al. | |
| 4,492,941 | A | | 1/1985 | Nagel | |
| 4,541,032 | A | | 9/1985 | Schwab | |
| 4,546,224 | A | | 10/1985 | Mostosi | |
| 4,550,360 | A | | 10/1985 | Dougherty | |
| 4,562,419 | A | | 12/1985 | Preuss et al. | |
| 4,589,052 | A | | 5/1986 | Dougherty | |
| 4,595,812 | A | | 6/1986 | Tamaru et al. | |
| 4,611,187 | A | | 9/1986 | Banfi | |
| 4,612,430 | A | | 9/1986 | Sloan et al. | |
| 4,616,198 | A | | 10/1986 | Pardini | |
| 4,622,444 | A | | 11/1986 | Kandatsu et al. | |
| 4,631,625 | A | | 12/1986 | Alexander et al. | |
| 4,642,431 | A | | 2/1987 | Tedesco et al. | |
| 4,644,438 | A | | 2/1987 | Puccinelli et al. | |
| 4,649,247 | A | | 3/1987 | Preuss et al. | |
| 4,658,322 | A | | 4/1987 | Rivera | |
| 4,672,501 | A | | 6/1987 | Bilac et al. | |
| 4,675,481 | A | | 6/1987 | Markowski et al. | |
| 4,682,264 | A | | 7/1987 | Demeyer | |
| 4,689,712 | A | | 8/1987 | Demeyer | |
| 4,694,373 | A | | 9/1987 | Demeyer | |
| 4,710,845 | A | | 12/1987 | Demeyer | |
| 4,717,985 | A | | 1/1988 | Demeyer | |
| 4,728,914 | A | * | 3/1988 | Morris et al. | 335/6 |
| 4,733,211 | A | | 3/1988 | Castonguay et al. | |
| 4,733,321 | A | | 3/1988 | Lindeperg | |
| 4,764,650 | A | | 8/1988 | Bur et al. | |
| 4,768,007 | A | | 8/1988 | Mertz et al. | |
| 4,780,786 | A | | 10/1988 | Weynachter et al. | |
| 4,831,221 | A | | 5/1989 | Yu et al. | |
| 4,870,531 | A | | 9/1989 | Danek | |
| 4,883,931 | A | | 11/1989 | Batteux et al. | |
| 4,884,047 | A | | 11/1989 | Baginski et al. | |
| 4,884,164 | A | | 11/1989 | Dziura et al. | |
| 4,900,882 | A | | 2/1990 | Bernard et al. | |
| 4,910,485 | A | | 3/1990 | Bolongeat-Mobleu et al. | |
| 4,914,541 | A | | 4/1990 | Tripodi et al. | |
| 4,916,420 | A | | 4/1990 | Bartolo et al. | |
| 4,916,421 | A | | 4/1990 | Pardini et al. | |
| 4,926,282 | A | | 5/1990 | McGhie | |
| 4,935,590 | A | | 6/1990 | Malkin et al. | |
| 4,937,706 | A | | 6/1990 | Schueller et al. | |
| 4,939,492 | A | | 7/1990 | Raso et al. | |
| 4,943,691 | A | | 7/1990 | Mertz et al. | |
| 4,943,888 | A | | 7/1990 | Jacob et al. | |
| 4,950,855 | A | | 8/1990 | Bolongeat-Mobleu et al. | |
| 4,951,019 | A | | 8/1990 | Gula | |
| 4,952,897 | A | | 8/1990 | Barnel et al. | |
| 4,958,135 | A | | 9/1990 | Baginski et al. | |
| 4,965,543 | A | | 10/1990 | Batteux | |
| 4,983,788 | A | | 1/1991 | Pardini | |
| 5,001,313 | A | | 3/1991 | Leclerq et al. | |
| 5,004,878 | A | | 4/1991 | Seymour et al. | |
| 5,027,091 | A | * | 6/1991 | Lesslie et al. | 335/132 |
| 5,029,301 | A | | 7/1991 | Nebon et al. | |
| 5,030,804 | A | | 7/1991 | Abri | |
| 5,057,655 | A | | 10/1991 | Kersusan et al. | |
| 5,077,627 | A | | 12/1991 | Fraisse | |
| 5,083,081 | A | | 1/1992 | Barrault et al. | |
| 5,095,183 | A | | 3/1992 | Raphard et al. | |
| 5,103,198 | A | | 4/1992 | Morel et al. | |
| 5,115,371 | A | | 5/1992 | Tripodi | |
| 5,120,921 | A | | 6/1992 | DiMarco et al. | |
| 5,132,865 | A | | 7/1992 | Mertz et al. | |
| 5,138,121 | A | | 8/1992 | Streich et al. | |
| 5,140,115 | A | | 8/1992 | Morris | |
| 5,153,802 | A | | 10/1992 | Mertz et al. | |
| 5,155,315 | A | | 10/1992 | Malkin et al. | |
| 5,166,483 | A | | 11/1992 | Kersusan et al. | |
| 5,172,087 | A | | 12/1992 | Castonguay et al. | |
| 5,178,504 | A | | 1/1993 | Falchi | |
| 5,184,717 | A | | 2/1993 | Chou et al. | |
| 5,187,339 | A | | 2/1993 | Lissandrin | |
| 5,198,956 | A | | 3/1993 | Dvorak | |
| 5,200,724 | A | | 4/1993 | Gula et al. | |
| 5,210,385 | A | | 5/1993 | Morel et al. | |
| 5,239,150 | A | | 8/1993 | Bolongeat-Mobleu et al. | |
| 5,260,533 | A | | 11/1993 | Livesey et al. | |
| 5,262,744 | A | | 11/1993 | Arnold et al. | |
| 5,280,144 | A | | 1/1994 | Bolongeat-Mobleu et al. | |
| 5,281,776 | A | | 1/1994 | Morel et al. | |
| 5,296,660 | A | | 3/1994 | Morel et al. | |
| 5,296,664 | A | | 3/1994 | Crookston et al. | |
| 5,298,874 | A | | 3/1994 | Morel et al. | |
| 5,300,907 | A | | 4/1994 | Nereau et al. | |
| 5,310,971 | A | | 5/1994 | Vial et al. | |
| 5,313,180 | A | | 5/1994 | Vial et al. | |
| 5,317,471 | A | | 5/1994 | Izoard et al. | |
| 5,331,500 | A | | 7/1994 | Corcoles et al. | |
| 5,334,808 | A | | 8/1994 | Bur et al. | |
| 5,341,191 | A | | 8/1994 | Crookston et al. | |
| 5,347,096 | A | | 9/1994 | Bolongeat-Mobleu et al. | |
| 5,347,097 | A | | 9/1994 | Bolongeat-Mobleu et al. | |
| 5,350,892 | A | | 9/1994 | Rozier | |
| 5,357,066 | A | | 10/1994 | Morel et al. | |
| 5,357,068 | A | | 10/1994 | Rozier | |
| 5,357,394 | A | | 10/1994 | Piney | |
| 5,361,052 | A | | 11/1994 | Ferullo et al. | |
| 5,373,130 | A | | 12/1994 | Barrault et al. | |
| 5,379,013 | A | | 1/1995 | Coudert | |
| 5,424,701 | A | | 6/1995 | Castonguary et al. | |
| 5,438,176 | A | | 8/1995 | Bonnardel et al. | |
| 5,440,088 | A | | 8/1995 | Coudert et al. | |
| 5,446,386 | A | * | 8/1995 | Pollman et al. | 335/132 |
| 5,449,871 | A | | 9/1995 | Batteux et al. | |
| 5,450,048 | A | * | 9/1995 | Leger et al. | 335/132 |
| 5,451,729 | A | | 9/1995 | Onderka et al. | |
| 5,457,295 | A | | 10/1995 | Tanibe et al. | |
| 5,467,069 | A | | 11/1995 | Payet-Burin et al. | |
| 5,469,121 | A | | 11/1995 | Payet-Burin | |
| 5,475,558 | A | | 12/1995 | Barjonnet et al. | |
| 5,477,016 | A | | 12/1995 | Baginski et al. | |
| 5,479,143 | A | | 12/1995 | Payet-Burin | |
| 5,483,212 | A | | 1/1996 | Lankuttis et al. | |
| 5,485,343 | A | | 1/1996 | Santos et al. | |
| D367,265 | S | | 2/1996 | Yamagata et al. | |
| 5,493,083 | A | | 2/1996 | Olivier | |
| 5,504,284 | A | | 4/1996 | Lazareth et al. | |
| 5,504,290 | A | | 4/1996 | Baginski et al. | |
| 5,510,761 | A | | 4/1996 | Boder et al. | |
| 5,512,720 | A | | 4/1996 | Coudert et al. | |
| 5,515,018 | A | | 5/1996 | DiMarco et al. | |
| 5,519,561 | A | | 5/1996 | Mrenna et al. | |
| 5,534,674 | A | | 7/1996 | Steffens | |

| | | | | | |
|---|---|---|---|---|---|
| 5,534,832 | A | | 7/1996 | Duchemin et al. | |
| 5,534,835 | A | | 7/1996 | McColloch et al. | |
| 5,534,840 | A | | 7/1996 | Cuingnet | |
| 5,539,168 | A | | 7/1996 | Linzenich | |
| 5,543,595 | A | | 8/1996 | Mader et al. | |
| 5,552,755 | A | | 9/1996 | Fello et al. | |
| 5,581,219 | A | | 12/1996 | Nozawa et al. | |
| 5,604,656 | A | | 2/1997 | Derrick et al. | |
| 5,605,467 | A | * | 2/1997 | Beck et al. | 439/148 |
| 5,608,367 | A | | 3/1997 | Zoller et al. | |
| 5,784,233 | A | | 7/1998 | Bastard et al. | |
| 5,877,925 | A | * | 3/1999 | Singer | 361/42 |

FOREIGN PATENT DOCUMENTS

| | | |
|---|---|---|
| EP | 0 235 479 | 9/1987 |
| EP | 0 239 460 | 9/1987 |
| EP | 0 258 090 | 3/1988 |
| EP | 0 264 313 | 4/1988 |
| EP | 0 264 314 | 4/1988 |
| EP | 0 283 189 | 9/1988 |
| EP | 0 283 358 | 9/1988 |
| EP | 0 291 374 | 11/1988 |
| EP | 0 295 155 | 12/1988 |
| EP | 0 295 158 | 12/1988 |
| EP | 0 309 923 | 4/1989 |
| EP | 0 313 106 | 4/1989 |
| EP | 0 313 422 | 4/1989 |
| EP | 0 314 540 | 5/1989 |
| EP | 0 331 586 | 9/1989 |
| EP | 0 337 900 | 10/1989 |
| EP | 0 342 133 | 11/1989 |
| EP | 0 367 690 | 5/1990 |
| EP | 0 371 887 | 6/1990 |
| EP | 0 375 568 | 6/1990 |
| EP | 0 394 144 | 10/1990 |
| EP | 0 394 922 | 10/1990 |
| EP | 0 399 282 | 11/1990 |
| EP | 0 407 310 | 1/1991 |
| EP | 0 452 230 | 10/1991 |
| EP | 0 555 158 | 8/1993 |
| EP | 0 560 697 | 9/1993 |
| EP | 0 567 416 | 10/1993 |
| EP | 0 595 730 | 5/1994 |
| EP | 0 619 591 | 10/1994 |
| EP | 0 665 569 | 8/1995 |
| EP | 0 700 140 | 3/1996 |
| EP | 0 889 498 | 1/1999 |
| FR | 2 410 353 | 6/1979 |
| FR | 2 512 582 | 3/1983 |
| FR | 2 553 943 | 4/1985 |
| FR | 2 592 998 | 7/1987 |
| FR | 2 682 531 | 4/1993 |
| FR | 2 697 670 | 5/1994 |
| FR | 2 699 324 | 6/1994 |
| FR | 2 714 771 | 7/1995 |
| GB | 2 233 155 | 1/1991 |
| WO | 92/00598 | 1/1992 |
| WO | 92/05649 | 4/1992 |
| WO | 94/00901 | 1/1994 |

* cited by examiner

RATING PLUG FOR CIRCUIT BREAKERS

BACKGROUND OF THE INVENTION

This invention relates to the field of circuit breakers. More particularly, this invention relates to the field of rating plugs for circuit breakers having electronic sensors or trip units.

Rating plugs for circuit breakers with electronic trip units are known in the art. The rating plug changes the operating curve for actuation of a breaker having an electronic circuit interrupter (trip unit), thus changing the ampere rating of the breaker. Not all rating plugs are compatible with all electronic trip units. Therefore, a known problem is to ensure that a rating plug is compatible with the electronic trip unit into which it is to be inserted.

For safety's sake, all electronic trip units with interchangeable rating plugs are required to reject incorrect combinations of rating plugs and trip units. This rejection is typically accomplished by the insertion of pins into the receptacle in the trip unit into which the rating plug is to be inserted. The pins, which are inserted into the side of the trip unit housing, interfere with protrusions on the side of the rating plug housing.

While workable, this prior art system has several drawbacks or disadvantages. One of these is that the interference between pins and protrusions does not occur until the rating plug is almost fully inserted into the trip unit. This can result in the user mistakenly thinking that insertion of the rating plug has been properly completed. Another problem is that the pins are independent elements, i.e., they are not part of the rating plug housing or the trip unit housing. As a result, a pin can be removed by someone tampering with the unit, and the user will not know whether a pin should be present or not.

BRIEF SUMMARY OF THE INVENTION

In an exemplary embodiment of the invention, an improved rating plug housing for a circuit breaker includes a recess formed in a portion of the circuit breaker housing. The recess has a projection formed on a bottom surface thereof. A rating plug, having an electronic portion arranged within a rating plug housing, is sized and shaped to fit into said recess. A tab extends from a bottom surface of said rating plug housing, said tab being arranged to contact said projection when said electronic portion is incompatible with a trip unit within said circuit breaker housing. If an attempt is made to insert an inappropriate rating plug into the circuit breaker housing, the tab on the rating plug unit will come into contact and interfere with the projection in the recess of the circuit breaker housing, and installation of the inappropriate rating plug will be prevented.

BRIEF DESCRIPTION OF THE DRAWINGS

Referring to the drawings, wherein like elements are numbered alike in the several figures.

DETAILED DESCRIPTION OF THE INVENTION

Figure 1:
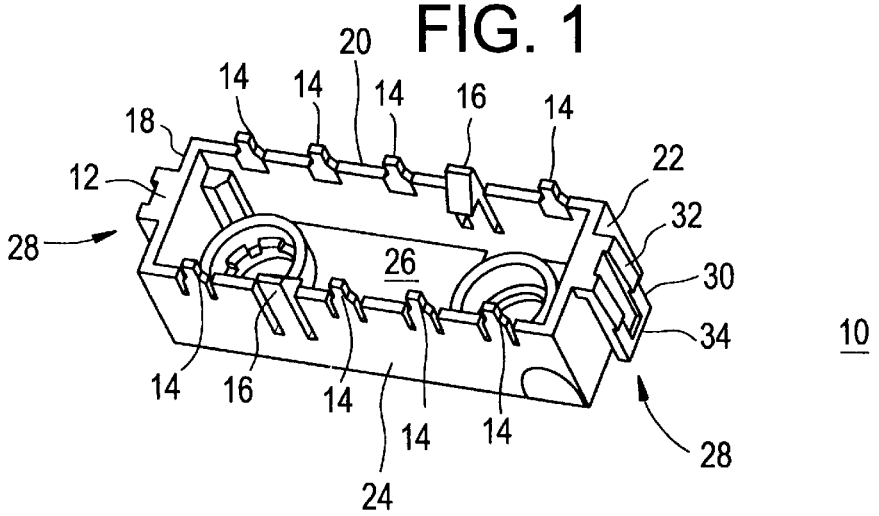
FIG. 1 is a bottom perspective view of the rating plug housing of the present invention.

Referring to FIG. 1, a rating plug housing 10 is shown for holding electronic portion of a rating plug. A good description of the electronic portion of rating plug is described in U.S. Pat. No. 4,649,455, which is incorporated herein by reference. Housing 10 is shown bottom side up. That is, in use, a bottom surface 12 is inserted first into the bottom of a recess in a trip unit housing forming part of a circuit breaker housing.

Rating plug housing 10 includes four side walls 18, 20, 22, 24 and a top wall 26 that form a cavity for accepting the electronic portion of the rating plug. Opposing sides 18 and 20 include resiliently flexible mounting tabs 28 extending from a portion thereof proximate bottom surface 12. Mounting tabs 28 each include a resiliently flexible leg 30 having angular detents 32 disposed thereon at an end of leg 30 attached to side 18 or 22. Each leg 30 also includes a free end 34. A series of projecting tabs 14 are formed projecting downward from opposing walls 20 and 24, beyond the bottom surface 12 of rating plug housing 10. Tabs 14 are formed in a predetermined pattern. The tab pattern is keyed to or commensurate with the rating plug to be carried by housing 10 and is also keyed to or commensurate with the trip unit housing into which it is to be inserted. A series of eight tabs 14 in a predetermined pattern are shown for purposes of illustration. Rating plug housing 10 is usually in the shape of a rectangle, and the tabs 14 are preferably, but not necessarily, located on opposing sides of the rectangle.

As is known in the art, rating plug housing 10 may also include detents 16 for holding a printed circuit board for the electronic portion of the rating plug. Top wall includes two apertures disposed therein, which may be used as test-jack access and indicating lamp visual access holes, as is known in the art.

Figure 2:
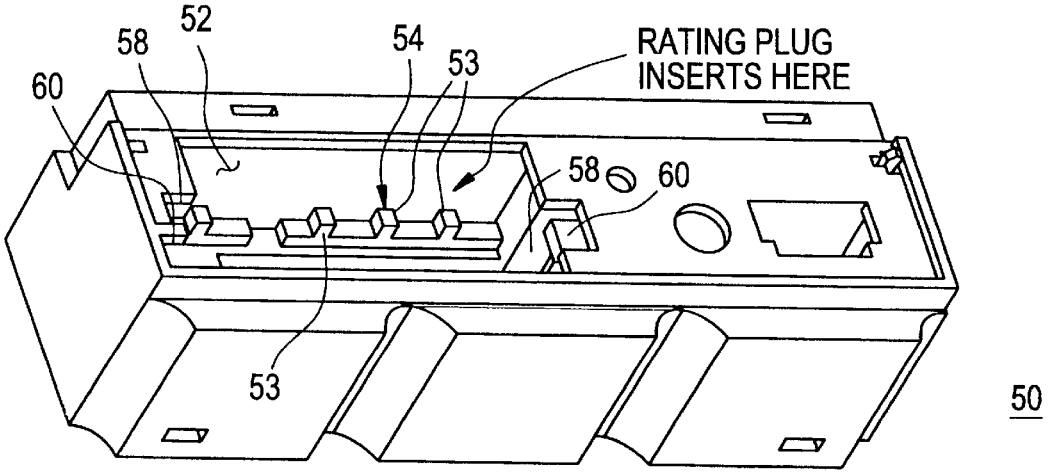
FIG. 2 is a top perspective view of a trip unit housing for receiving the rating plug of FIG. 1.
Figure 3:
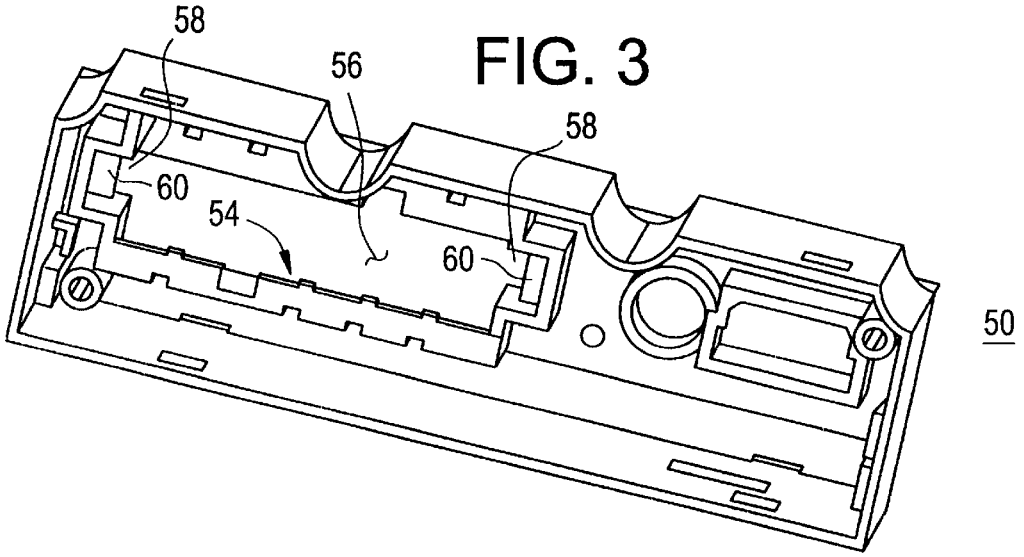
FIG. 3 is a bottom perspective view of a trip unit housing for receiving the rating plug of FIG. 1.

Referring now to FIGS. 1, 2 and 3, an electronic trip unit housing 50 is shown for accepting rating plug housing 10. FIG. 2 shows a perspective view of the top side of trip unit housing 50. FIG. 3 shows a perspective view of the bottom side of trip unit housing 50. Electronic trip unit housing 50 forms part of a circuit breaker housing (not shown) for securing the electrical portion of a trip unit within the circuit breaker housing. No details of the electronic portion of the trip unit, per se, are shown, since they form no part of the invention. This trip unit housing 50 has a rectangular recess 52 into which rating plug housing 10 (with the electronic portion of the rating plug housed therein) is to be inserted. The bottom of recess 52 has a series of upright projections 53 arranged to form castellations 54 extending upwardly from the bottom of recess 52, also preferably along the long sides of the rectangular recess 52. Although only one row of castellations 54 is shown along one long side wall of recess 52, it will be understood that a similar set of these castellations is also located on the opposite long side wall of recess 52. Castellations 54 are also formed in a predetermined pattern keyed to or commensurate with the rating of the electronic trip unit. The pattern of castellations 54 corresponds to the pattern of tabs 14. A center portion 56 of the bottom of recess 52 is open to allow the electronic portion of the rating plug to connect with the electronic portion of the trip unit when the rating plug is fully inserted in recess 52. Electrical connection between the electronic portions of the trip unit and rating plug is made in a manner described in U.S. Pat. No. 4,754,247, entitled MOLDED CASE CIRCUIT BREAKER ACCESSORY ENCLOSURE, which is incorporated herein by reference. Slots 58 are formed on opposing short sides of rectangular recess 52, with tabs 60 extending therein. Slots 58 are arranged to slidably accept resiliently flexible mounting tabs 28 when rating plug housing 10 is inserted into rectangular recess 52.

While the embodiment described herein includes recess 52 and castellations 54 as part of trip unit housing 50, one skilled in the art will recognize that these features could be included in any part of the circuit breaker housing in which the rating plug is to be inserted. For example, aforementioned U.S. Pat. No. 4,754,247 describes a rating plug recess formed in an accessory cover of a circuit breaker.

For any given electronic trip unit, the rating plug housing 10 to be compatible therewith are formed with a pattern of protruding tabs 14 located so that there will be no interference between the tabs 14 and the castellations 54 when the rating plug housing 10 (and associated electronic portion) is installed in recess 54. That is, all of the tabs 14 and all of the projections 53 of castellations 54 will be offset relative to each other. Accordingly, the tabs 14 will pass between the projections 53, and the rating plug housing 10 will be permitted to fully seat in recess 54, allowing the electronic portions of the trip unit and rating plug to electrically connect. When rating plug housing 10 is fully installed into rectangular recess 52, detents 32 on mounting tabs 28 will engage tabs 60, thereby securing rating plug housing 10 within rectangular recess 52. However, if an attempt is made to insert an incompatible, i.e., unauthorized, rating plug into a recess 52, one or more tabs 14 will be fully or partially aligned with one or more projections 53 of castellations 54. Accordingly, one or more of the tabs 14 will contact and interfere with one or more projections 53, preventing the installation of the rating plug housing 10 into recess 52.

In a further embodiment of the present invention, the housing 10 and trip unit housing 50 are formed with projecting tabs 14 and castellations 54 that are not formed in a predetermined pattern but rather a universal pattern such that one housing 10 or trip unit housing 50 design can be used for a variety of different trip unit/rating plug combinations. The required tab pattern is created by the selective removal of the proper tabs 14 and projections 53 using a tool (not shown). In this way, the projecting tabs 14 and projections 53 are removed in a pattern to control the insertion of the rating plug housing 10 into the trip unit housing 50. The tab 14 and projection 53 pattern is keyed to or commensurate with the rating plug to be carried by housing 10 and is also keyed to or commensurate with the trip unit housing 50 into which it is to be inserted. The tool for removal of tabs 14 and projections 53 may be manual or automated. Such a tool may include, for example, a pliers having handles extending from pivoted jaws. The jaws may include blades extending across each jaw for snipping tabs 14 or projections 53 from housing 10. The jaws may have a width substantially equal to the width of tab 14, thereby allowing tabs 14 to be snipped at a point within wall 20 or 24 deeper than bottom surface 12 without marring walls 20 or 24. Thus, if the tabs 14 are removed with the use of the tool, then the exposed surface of walls 20 and 24 and the break made where the tab 14 was removed will be smooth. Similarly, if the projections 53 are removed with the use of the tool, then the exposed surfaces within recess 52 will be smooth and the break made where the projection 53 was removed will be smooth. However, if the tabs 14 or projections 53 are removed without the use of the tool, then the exposed surface of walls 20 and 24 and the break made where the tab 14 or projection 53 was removed will be rough or jagged in outward appearance. The tool may also be arranged to create a signature mark in housing 10 or within recess 52 near a removed tab 14 or projection 53 to show that the tab 14 or projection 53 was properly removed using the tool. Such a signature mark may include, for example, a unique design formed at the point where tab 14 or projection 53 was snipped from housing 10 or 50. The blades of the tool may be shaped to create such a signature mark at the break made where tab 14 or projection 53 was removed.

Removal of an installed rating plug housing 10 from recess 52 is achieved by bending the free ends 34 of legs 30 towards sides 18, 22, thereby disengaging detents 32 from tabs 60. Rating plug housing 10 can then be drawn upwards, out of recess 52.

The improved rating plug housing 10 of the present invention has several advantages over the prior art. The tabs 14 are an integral part of the rating plug housing. That eliminates the need for separate pins and the problems inherent in the separate pin approach. Particularly, it eliminates the problem of tampering by unauthorized removal of separate pins. If someone tampers with a tab 14 of the present invention by breaking off the tab to remove the tab, the tampering will be visually apparent to the user of the rating plug. Another prior art problem that is overcome is that an attempted insertion of an improper rating plug of the present invention will be rejected early in the insertion process because of the combined lengths of tabs 14 and castellations 22. This eliminates the problem of a user mistakenly thinking that the rating plug has been fully seated. Yet another advantage over the prior art is that the rating plug housing 10 and trip unit housing 50 of the present invention allow the use of a universal pattern such that one housing 10 or trip unit housing 50 design can be used for a variety of different trip unit/rating plug combinations.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A method of keying a rating plug enclosure comprising:

determining electronics of said rating plug;

integrally forming a plurality of tabs with the enclosure, said tabs extending outwardly from said enclosure and positioned to interfere with keyed projections of a trip unit recess, removing at least one of said tabs according to the electronics of said rating plug so that said rating plug can only be inserted into recesses of electrically compatible circuit breakers.

2. The method of claim 1 wherein said removing comprises using a tool to remove said at least one of said tabs.

3. The method of claim 2 further comprising leaving a signature mark in said rating plug enclosure with said tool simultaneously with said removing.

4. The method of claim 1 wherein said integrally forming comprises forming said tabs as an extension of one wall of said housing and extending beyond an end of said wall; each tab having a base inset from said end, and said removing comprises removing said at least one of said tabs at a point inset from said end, thereby avoiding any projections at a location of each removed tab.

5. The method of claim 1 further comprising inserting rating plug electronics in said enclosure and said removing comprises removing tabs corresponding to said rating plug electronics.

* * * * *